US005389111A

United States Patent [19]

Nikanjam et al.

[11] Patent Number: 5,389,111

[45] Date of Patent: Feb. 14, 1995

[54] LOW EMISSIONS DIESEL FUEL

[75] Inventors: Manuch Nikanjam, Richmond; Richard F. Sullivan, San Rafael, both of Calif.

[73] Assignee: Chevron Research and Technology Company, San Francisco, Calif.

[21] Appl. No.: 69,637

[22] Filed: Jun. 1, 1993

[51] Int. Cl.[6] ..... C10L 1/04; C10L 1/22

[52] U.S. Cl. ..... 44/300; 44/324; 585/14

[58] Field of Search ..... 44/324, 300; 585/14

[56] References Cited

U.S. PATENT DOCUMENTS

| | | | |
|---|---|---|---|
| 4,522,630 | 6/1985 | Seemuth | 44/324 |
| 4,536,190 | 8/1985 | Seemuth | 44/324 |
| 5,258,049 | 11/1993 | Liotta et al. | 44/324 |

*Primary Examiner*—Jacqueline V. Howard
*Attorney, Agent, or Firm*—V. J. Cavalieri

[57] ABSTRACT

A low emissions diesel fuel with prescribed levels of aromatics and cetane number is disclosed which, when combusted in a diesel engine, results in lower emissions than the California Reference diesel fuel.

7 Claims, 2 Drawing Sheets

EFFECT OF TEMPERATURE ON EQUILIBRIUM OF AROMATICS AT VARIOUS H2 PRESSURES

LOW EMISSIONS DIESEL FUEL

FIELD OF INVENTION

This invention relates to a motor fuel composition. More specifically, it relates to a diesel fuel having defined levels of aromatic compounds and cetane rating resulting in low levels of atmospheric emissions following combustion in a diesel-type engine.

BACKGROUND OF THE INVENTION

Diesel-type engines are well known for being highly durable and fuel efficient. Because of this durability and fuel efficiency, diesel-type engines have long been used in heavy-duty motor vehicles, such as trucks, buses and locomotives.

Diesel fuel can be made from any number of components that are produced in an oil refinery. The American Society for Testing and Materials (ASTM) has set specifications for diesel fuels. Some states, including California, have adopted those specifications as legal requirements.

Diesel fuels may be produced from refinery streams that have the qualities required to meet the ASTM specifications. No. 2 diesel fuel is produced from hydrocarbon stocks that are referred to as gas oils. No. 1 diesel fuel is produced from refinery streams that lie in the kerosene boiling range. All fuels that lie within the boiling range of No. 1 and No. 2 diesel fuel are referred to generically as "distillate".

Historically, diesel engines have been operated on a petroleum-derived liquid hydrocarbon fuel boiling in the range of about 300° F.–750° F. (149° C.–399° C.). Modern petroleum refineries can produce high quality diesel fuels containing large straight-chain paraffins. However, due to competing demands for other products, limitations imposed by poor quality heavy crude oils, and other factors, refineries frequently are unable to meet the total demand for such diesel fuels. Many believe that projected demand for diesel fuels will increase by 26 percent from the year 1990 to the year 2010.

Diesel engines rely on compression ignition of the fuel. The source of ignition energy is the high temperature, high pressure air present in the combustion chamber towards the end of the compression stroke. To achieve these high temperatures and pressures, diesel engines typically have far higher compression ratios than do gasoline engines.

Upon injection into the combustion chamber, fuel must quickly mix with air to form a flammable mixture and the mixture must ignite. Since there is normally no additional means for ignition (such as the spark plug in gasoline engines), the fuel must self-ignite, a process called "autoignition". This process takes time and is influenced greatly by the engine combustion system and by fuel properties.

Diesel engines use the heat developed by compressing a charge of air to ignite the fuel injected into the engine cylinder after the air is compressed. More specifically, in the engine, the air is first compressed, then fuel is injected into the cylinder; as fuel contacts the heated air, it vaporizes and finally begins to burn as the self-ignition temperature is reached. Additional fuel is injected during the compression stroke and this fuel burns almost instantaneously, once the initial flame has been established.

A period of time elapses between the beginning of fuel injection and the appearance of a flame in the cylinder. This period is commonly called "ignition delay" and is a major factor in regard to the performance of a diesel fuel. If ignition delay is too long, the fuel will accumulate in the cylinder until it reached ignition conditions and then will burn rapidly, causing a sudden pressure increase which may result in engine knocking. Too long an ignition delay may result in a smokey exhaust, a decrease in engine efficiency, and possibly dilution of the crank case oil. A reduction in ignition delay can be obtained by varying the chemical nature of the injected fuel. Straight-chain paraffinic hydrocarbons give the least ignition delay, while branched-chain paraffins and cyclic (including aromatic) hydrocarbons tend to have poorer ignition characteristics. Aromatic hydrocarbons are relatively compact and unreactive molecules compared to the other prime constituents of diesel fuel. Consequently, aromatics tend to resist ignition and be low in cetane number.

For this reason, n-hexadecane ("cetane") has long been used as a standard reference material for determining the ignition quality of commercial diesel fuels. A scale called "cetane number" has been devised for ranking the relative ignition delay characteristics of a given diesel fuel. The cetane number of an unknown fuel is determined by comparing its ignition delay in a standard test engine with reference fuels which are prepared by blending cetane (assigned a rating of 100) and 2,2,4,4,6,8,8 heptamethylnonane (assigned a rating of 15) until a reference fuel is found to have the same ignition delay characteristics as the unknown fuel; the cetane number is obtained by the equation:

$$\text{Cetane No.} = (\text{Vol. \% Cetane}) + [0.15\ (\text{Vol. \% Heptamethylnonane})]$$

In general, large stationary engines which run at fairly constant speeds and loads have the lowest cetane number requirements (e.g., 30 to 45), while smaller motor vehicle diesel engines have the highest requirements (e.g., 40 to 55) for obtaining optimum performance.

One of the more important difficulties that arises through the use of diesel engines is the problem of starting the engine when it is cold. Fuels with high cetane numbers have the advantage of giving relatively easy starting at low temperatures. Additionally, fuels with high cetane numbers reduce destructive combustion knock, provide more efficient combustion and smooth engine operation, lower maximum cylinder pressures, and reduce carbon deposits on cylinder heads.

Cetane rating, which is measured (and defined) by a standard cetane test engine according to a procedure carefully detailed in American Society for Testing and Materials Standard D-613, *Test Method for Ignition Quality of Diesel Fuels by the Cetane Method,* is critical. A high cetane rating means the fuel autoignites relatively easily and exhibits a shorter ignition delay than a fuel with a low cetane rating, the reverse of the octane rating of gasoline where octane measures a fuel's resistance to autoignition.

Through the years, many types of additives have been prepared to raise the cetane number of diesel fuels. Such additives usually contain nitrogen or sulfur, both of which are known cetane improvers under certain circumstances. The most popular additives, for example, appear to be hexyl or octyl nitrate. However, these additives are highly combustible, as are most of the organic nitrogen- or sulfur-containing additives commonly used. Further, the nitrogen-containing compounds can add to an engine's $NO_x$ emissions, which contribute to photochemical reactions known to cause smog formation, as well as formation of nitric acid, a factor in acid rain. The sulfur-containing compounds contribute to $SO_x$ formation which can contaminate the lube oil by forming sulfuric acid which breaks down various antiwear additives found in the oil. Also, $SO_x$ emissions contribute to the formation of particulate matter in the form of sulfates which must be emitted from the exhaust.

Despite many years of work and billions of dollars spent by both government and industry in fighting air pollution, air quality problems remain a major problem. Motor vehicles powered by diesel combustion engines are a contributing factor to many of these problems.

Research over the past few years has focused attention on the fact that increasing the cetane number of typical diesel fuels has beneficial effects on diesel exhaust emissions. However, diesel combustion is a very complex process far more so than gasoline engine combustion. Much is yet to be learned about the detailed mechanisms leading to emissions from diesel engines. As just one example, it is known that various diesel engine designs respond very differently to changes in fuel characteristics. Some engines will exhibit dramatic effects in one direction, others in the opposite direction, and still others will not respond at all. This is because engine hardware comprising the injection system, the combustion chamber design, the inlet system design, among many other parts of the engine, affect engine performance and emissions far more than do variations in the normal range of fuel characteristics.

In the production of diesel fuels in a refinery, some process modifications are available, but at an extremely high cost. Process options required to meet new diesel fuel standards have been projected to cost over $2 billion in California alone. The non-process options include (I) the segregation of the regulated vehicular No. 2 diesel fuel from other distillate products so that only the regulated No. 2 diesel fuel would be required to meet regulations regarding low aromatic hydrocarbon/low sulfur content standards, and (II) the purchase and importation of low aromatic hydrocarbon/low sulfur blendstocks from outside California.

The potential process options referred to above include the olefins-to-gasoline process. Also of potential for process options are certain distillate processes, which employs methanol as a feedstock, and several hydroprocessing options which use hydrogen and a catalyst to reduce the aromatic hydrocarbon content.

Higher concentrations of fuel aromatics, beyond their effect on cetane number, also appear to cause small increases in particulate and oxides of nitrogen emissions. In general, aromatic hydrocarbons have a higher flame temperature relative to the other prominent components of diesel fuel.

This higher temperature may, by itself, lead to higher oxides of nitrogen formation.

The State of California has defined a diesel fuel containing an extremely low level of aromatic compounds for adoption by fuel suppliers for sale in the State, hereinafter referred to as "California LAD". While California LAD may have advantages in the form of lower exhaust emissions relative to diesel fuel produced and sold today, the production cost impact upon refiners who must adopt processes to produce California LAD is enormous.

The proposed California regulation requires a minimum of 10% aromatics content in vehicular diesel fuel starting on Oct. 1, 1993. Compliance with the low aromatics rule could require major investments in California refineries. Refiners have the potentially less costly option of producing a higher aromatics diesel fuel if they can demonstrate equivalent emissions relative to a 10% aromatics reference fuel.

Lowering the aromatics content of diesel fuel from the current levels of well over 30% to those below 10% requires major capital investment and operating cost for severe hydrotreating processes in most California refineries. This is a severe financial burden during a period in which very large capital funds are needed to make the many changes required for producing reformulated gasoline and for complying with a range of other environmental regulations. The California Air Resources Board has allowed fuel producers the option of producing a less costly alternative fuel with a higher aromatics content, if equivalent emissions can be demonstrated. We took on the challenge of developing such an alternative fuel and were successful in receiving the first certification from the California Air Resources Board for an alternative diesel fuel. Thus, while our invention did not produce a diesel fuel with lower than 10% aromatics, we were successful in producing a higher aromatics diesel fuel which demonstrated an equivalent emissions relative to the 10% aromatics reference fuel.

A candidate fuel to be tested for emissions equivalency must meet the ASTM D975 diesel fuel specifications. In addition, the following five fuel properties must also be determined:

1. Sulfur content (not to exceed 500 ppm);
2. Total aromatic hydrocarbon content;
3. Polycyclic aromatic hydrocarbon content;
4. Nitrogen content;
5. Cetane number.

Once the fuel is certified "equivalent", a producer can market the equivalent fuel as long as the first four of the above properties are not exceeded. The above determined cetane number is the minimum allowable.

The goal we achieved was to obtain a fuel which would pass the certification test, yet be as economical as possible to produce. While fuels with higher cetane numbers and lower aromatics relative to the fuels of this invention may also be demonstrated to be better than or equivalent relative to a 10% aromatics reference fuel, as recommended by the California Air Resources Board, such fuels would be more expensive to produce; i.e., raising the cetane number and/or lowering the aromatics content involves either extra processing steps or extra additives or both which increases the cost of the fuel.

Thus, we have found a balance between cetane number and aromatics content which provides an economical fuel which passes the California Air Resources Board certification test.

It is clear that formulation of a diesel fuel which minimizes the cost impact on fuel refiners and fully meets the emissions requirements of the California Air Resources Board is much desired.

SUMMARY OF THE INVENTION

We have discovered a Low Emissions Diesel Fuel composition having an Aromatics Content in the range of from 13 to 20 percent by weight, preferably in the range of from 15 to 19 percent by weight, and a Cetane Number in the range of from 54 to 60, preferably in the range of from 55 to 59, said Cetane Number and Aromatics Content being within the tetragonal area defined by Points A, B, C and D shown in FIG. 1. The relationship of Cetane Number and Aromatics Content may be expressed according to the equation:

$$\text{Aromatics Content} = \text{Cetane} - 40$$

within the limits such that:

$$\text{Cetane} - 41 < \text{Aromatics Content} \leqq \text{Cetane} - 40$$

wherein $54 \leqq \text{Cetane Number} \leqq 60$. Most preferably, the Cetane Number is in the range of 55 to 59 and the Aromatics Content is in the range of 15 to 19, and wherein the Cetane Number and Aromatics Content lie on Line A–B of FIG. 1; whereby statistically determined emissions resulting from combusting said Low Emissions Diesel Fuel in an internal combustion engine are less than statistically determined emissions resulting from combustion of California Reference diesel fuel in said internal combustion engine.

In the manufacture of the improved diesel fuel, cetane improver may be added in commercial amounts of up to about 0.40 wt. percent. One cetane improver we have found to give particularly good results in making our present invention is 2-ethyl-hexyl nitrate.

The hydrocarbon fuel composition of the present invention may also comprise other additives, such as dyes, oxidation inhibitors, etc.

Among other factors, we determined that when a diesel fuel was formulated to comprise a percent by weight aromatics and the cetane numbers shown in the tetragonal area A, B, C and D in FIG. 1, the diesel fuel formulation resulted in lower emissions of critical engine emissions and met the requirements for comparative emissions set forth hereinbelow relative to the hereinbelow defined California Reference diesel fuel.

Surprisingly, the diesel fuel compositions we have discovered were successful in meeting the emissions tests relative to California Reference diesel fuel. This was particularly unobvious because higher aromatics are known to adversely affect emissions performance. Further, the comparison tests were found to be achievable at a lesser cetane number than we anticipated, given the above relatively high aromatics content.

Also to our surprise, the reformulated low aromatics diesel composition of our invention may be commercially produced in a modern refinery without the substantial process modifications required to produce a diesel fuel having the far lesser aromatics content of California LAD.

DETAILED DESCRIPTION OF THE INVENTION

Whenever the expression "diesel fuel" is employed in the following description and claims, it is to be understood that it designates that hydrocarbon fraction which distills after kerosine which is commonly or commercially known, sold or represented as diesel fuel No. 2-D, pursuant to the specifications in ASTM Standard Specification for Diesel Fuel Oils D 975-81, which is incorporated herein by reference.

Typical diesel fuel property requirements are those given on pages 11–37 of the "Petroleum Processing Handbook", 1967 Edition. Generally, the diesel fuel will comprise a mixture of hydrocarbons boiling in the range of 350° F. to 700° F.

"Polycyclic aromatic" means the sum of the concentrations of the compound types defined in Paragraphs 3.8 through 3.12 of ASTM D 2425-83, which is incorporated herein by reference.

The aromatic hydrocarbon content limitation, expressed as "volume %" in defining the California Reference diesel fuel described herein, is determined by ASTM Test Method D 1319-84, which is incorporated herein by reference, but modified in Section 1.1 for the purposes of defining the reference fuel to read:

"1.1 This test method covers the determination of hydrocarbon types over the concentration ranges from 5 to 99 volume % aromatics, 0.3 to 55 volume % olefins, and 1 to 95 volume % saturates in No. 1-D and No. 2-D diesel fuel."

By the phrase "weight percent" in reference to the aromatics content of the fuel composition of our invention, we mean the percent by weight as determined by ASTM 5186-91, which is incorporated by reference herein.

Figure 1:
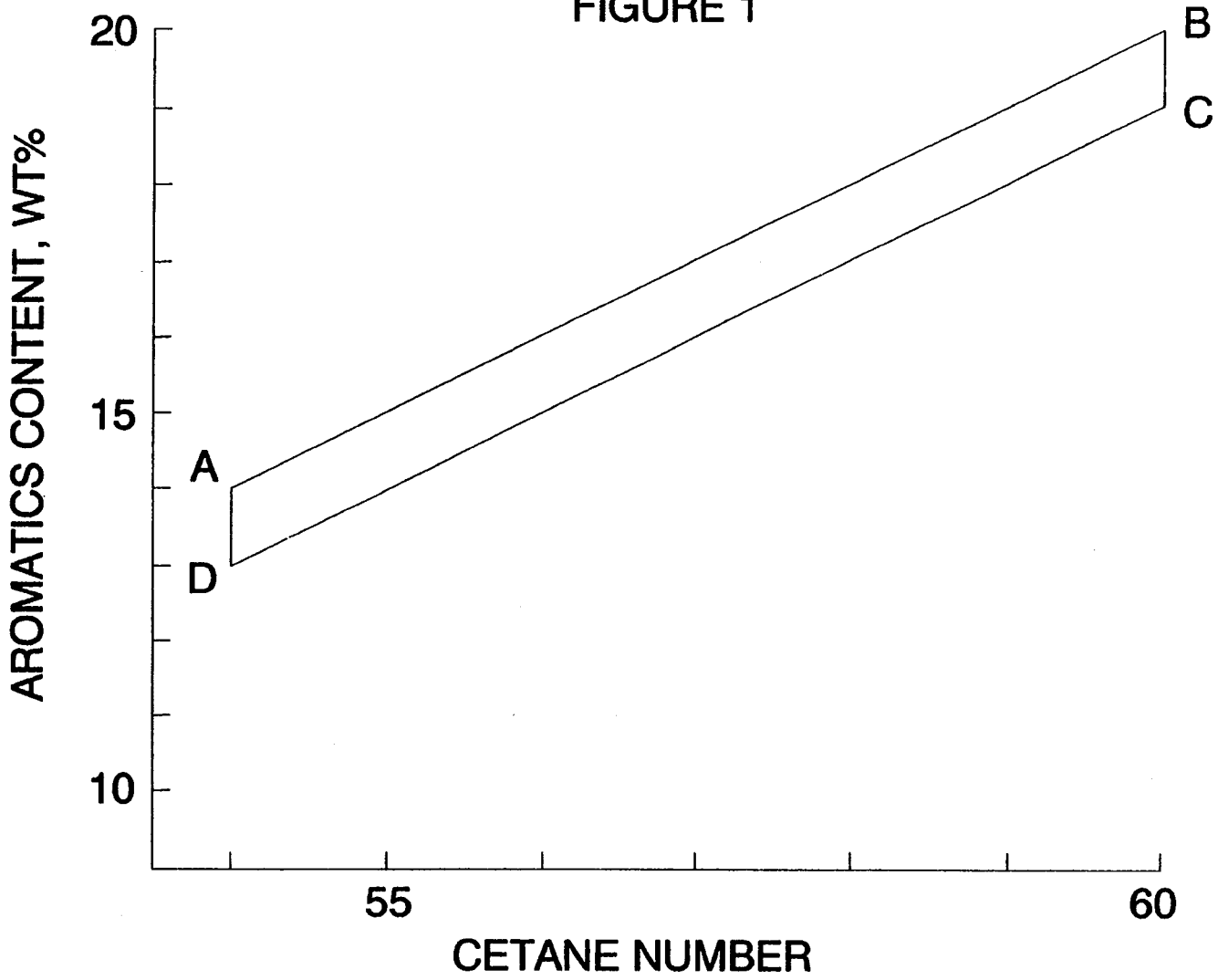
FIG. 1 is a binary diagram showing Aromatics Content in weight percent and Cetane Number for the diesel fuels of this invention.

We have discovered a Low Emissions Diesel Fuel composition comprising the Aromatics Content and Cetane Numbers as shown in the tetragonal area A, B, C and D of FIG. 1; whereby statistically determined emissions resulting from combusting said Low Emissions Diesel Fuel in an internal combustion engine are less than statistically determined emissions resulting from combustion of California Reference diesel fuel in said internal combustion engine.

In characterizing our present invention, the following characteristics of the fuel are determined as the average of three tests conducted in accordance with the referenced test method (ASTM methods are incorporated herein by reference):

(a) Sulfur content (not to exceed 500 ppm), by ASTM D2622-82;
(b) Total aromatic hydrocarbon content, by ASTM D5186-91;
(c) Polycyclic aromatic hydrocarbon content, by ASTM D2425-83;
(d) Nitrogen content, by ASTM D4629-86;
(e) Cetane number, by ASTM D613-84;
(f) Identity and concentration of any additive, by known test methods to adequately determine the presence and concentration of the additive.

The fuel herein referred to as "California Reference diesel fuel" and used in comparative testing for the purpose of defining our present invention is produced from straight-run California diesel fuel by a hydrodearomatization process and has the characteristics set forth in Table I (the listed ASTM methods are incorporated herein by reference):

TABLE I

REFERENCE FUEL SPECIFICATIONS

| Property | ASTM Test Method | Reference Fuel Specifications |
|---|---|---|
| Sulfur Content | D2622-82 | 500 ppm max. |

TABLE I-continued

| REFERENCE FUEL SPECIFICATIONS | | |
|---|---|---|
| Property | ASTM Test Method | Reference Fuel Specifications |
| Aromatic Hydrocarbon Content, Vol. % | D1319-84 | 10% max. |
| Polycyclic Aromatic Hydrocarbon content, Wt. % | D2425-83 | 1.4% max. |
| Nitrogen Content | D4629-86 | 10 ppm max. |
| Natural Cetane Number | D613-84 | 48 minimum |
| Gravity, API | D287-82 | 33–39 |
| Viscosity at 40°, cST | D445-83 | 2.0–4.1 |
| Flash point, °F., (min.) | D93-80 | 130 |
| Distillation, °F. | D86-82 | |
| IBP | | 340–420 |
| 10% REC. | | 400–490 |
| 50% REC. | | 470–560 |
| 90% REC. | | 550–610 |
| EP | | 580–660 |

Comparative exhaust emission tests using the diesel fuel composition of our present invention and the California Reference diesel fuel are defined by testing conducted in accordance with the "California Exhaust Emission Standards and Test Procedures for 1985 and Subsequent Model Heavy-Duty Diesel-Powered Engines and Vehicles", as incorporated by reference in Title 13, California Code of Regulations, Section 1956.8(b), also incorporated herein by reference.

The Low Emissions Diesel Fuels of our invention contain less than about 202 ppm sulfur; less than 466 ppm nitrogen; and less than 4.68% polynuclear aromatics.

In accordance with our present invention, in comparing the statistically determined emissions of a diesel fuel ("candidate fuel") to the California reference fuel, one of the following test sequences is selected:

1. If both cold start and hot start exhaust emission tests are conducted, a minimum of five exhaust emission tests are performed on the engine with each fuel, using either of the following sequences, where "R" is the reference fuel and "C" is the candidate diesel fuel: RC RC RC RC RC (and continuing in the same order), or RC CR RC CR RC (and continuing in the same order).
   Engine mapping procedures and a conditioning transient cycle are conducted with the reference fuel before each cold start procedure using the reference fuel. The reference cycle used for the candidate fuel is the same cycle as that used for the fuel preceding it.
2. If only hot start exhaust emission tests are conducted, one of the following test sequences is used throughout the testing, where "R" is the reference fuel and "C" is the candidate fuel:
   Alternative 1: RC CR RC CR (continuing in the same order for a given calendar day; a minimum of twenty individual exhaust emission tests must be completed with each fuel).
   Alternative 2: RR CC RR CC (continuing in the same order for a given calendar day; a minimum of twenty individual exhaust emission tests must be completed with each fuel).
   Alternative 3: RRR CCC RRR CCC (continuing in the same order for a given calendar day; a minimum of twenty-one individual exhaust emission tests must be completed with each fuel).

For all alternatives, an equal number of tests are conducted using the reference fuel and the candidate fuel on any given calendar day. At the beginning of each calendar day, the sequence of testing begins with the fuel that was tested at the end of the preceding day. The engine mapping procedures and a conditioning transient cycle is conducted after every fuel change and/or at the beginning of each day. The reference cycle generated from the reference fuel for the first test is used for all subsequent tests. For alternatives 2 and 3, each paired or triplicate series of individual tests are averaged to obtain a single value which would be used in calculations of emissions.

In each test of a fuel, exhaust emissions of oxides of nitrogen ($NO_x$) and particulate matter (PM) are measured. In addition, for each test the soluble organic fraction (SOF) of the particulate matter in the exhaust emissions are determined in accordance with the California Air Resources Board's published "Test Method for Soluble Organic Fraction (SOF) Extraction" dated April 1989, which is incorporated herein by reference.

The average emissions during testing with the candidate fuel are statistically determined by comparing the average emissions during testing with the reference fuel, applying one-sided Student's t statistics as set forth in Snedecar and Cochran, *Statistical Methods*, (7th ed.), page 91, Iowa State University Press, 1980, which is incorporated herein by reference.

A candidate diesel fuel meets the California definition for lower emissions if:

(A) The average individual emissions of $NO_x$ and SOF, respectively, during testing with the candidate fuel do not exceed the average individual emissions of $NO_x$ and SOF, respectively, during testing with the reference fuel.

(B) The average emissions of PM during testing with the candidate fuel, reduced by the lesser of (1) the secondary sulfate particulate credit, or (2) the sulfate portion of the average emissions of PM during testing with the candidate fuel, does not exceed the average emissions of PM during testing with the reference fuel, where:

Secondary sulfate particulate credit (g/BHP−h) = 10.42 × (fuel sulfur content difference, wt. %) × (BSFC, 1 b/BHP−h);

Fuel Sulfur Content Difference = The difference in sulfur content between 500 ppm and the sulfur content of the candidate fuel;

BSFC = The brake specific fuel consumption measured during the engine tests; and The sulfate portion of PM emissions is determined by California Air Resources Board Method NLB007, dated Jul. 27, 1988, which is incorporated herein by reference.

(C) Use of any additive in heavy-duty engines will not increase emissions of noxious or toxic substances which would not be emitted by such engines operating without the additive.

(D) In order for the determination in subparagraphs (A) and (B) to be made, that is, for a fuel to be statistically determined to result in less emissions relative to the reference fuel, for each referenced pollutant the candidate fuel must satisfy the following relationship:

$$\bar{X}_C < \bar{X}_R + \Delta - S_p \cdot \sqrt{\frac{2}{n}} \cdot t(a, 2n-2)$$

Where $\bar{X}_C$=Average emissions during testing with the candidate fuel.

$\bar{X}_R$=Average emissions during testing with the California Reference diesel fuel.

$\Delta$=Tolerance level equal to 2 percent of $\bar{X}_R$ for NOx, 4 percent of $\bar{X}_R$ for PM, and 12 percent of $\bar{X}_R$ for SOF.

$S_P$=Pooled standard deviation.

t (a, 2n−2)=The one-sided upper percentage point of t distribution with a=0.15 and 2n−2 degrees of freedom.

n=Number of tests of candidate fuel and the California Reference diesel fuel.

One skilled in the art of refining diesel fuels from crude oil will recognize that there are many operating parameters and refining routes to achieve the diesel composition of our present invention. As straight-run diesel may typically contain over 30% aromatics, hydrodearomatization in a hydrotreater using a noble metal catalyst is one possible processing route. Lowering the hydrotreating severity or blending an extremely low aromatics content diesel with a straight-run diesel will also be recognized as potential means to produce the particular diesel fuel of our invention.

Figure 2:
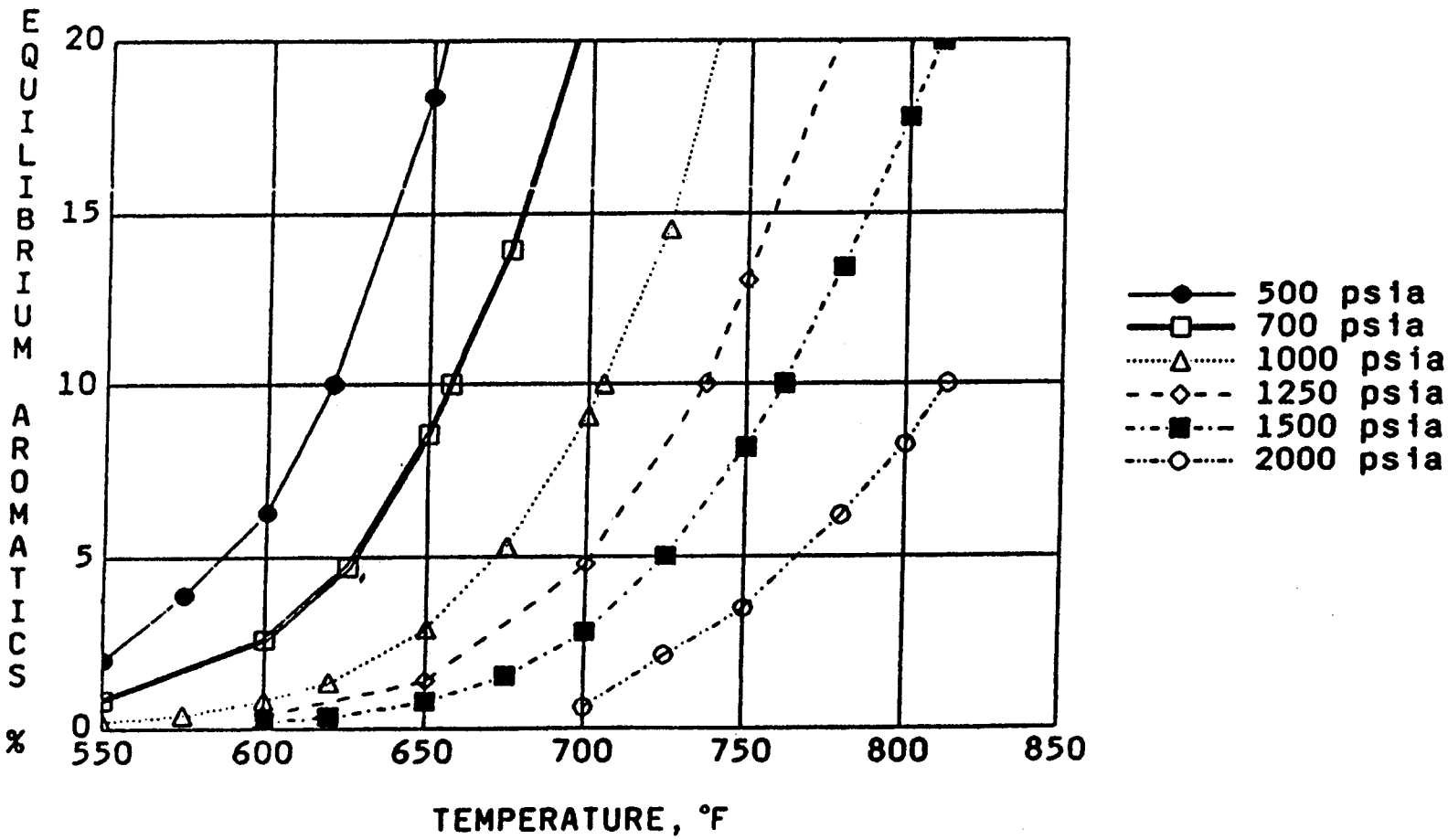
FIG. 2 graphically depicts the aromatics content of a diesel fuel as a function of hydrogen pressure and temperature.

Hydrotreaters may be a single-stage type, with LHSV of between about 0.5 and about 3, or they may be two-stage type hydrotreaters. We have achieved good results utilizing a VGO desulfurization reactor in one case. Choices as to the particular refining route to produce the diesel fuel of our invention will be made on the basis of individual refinery configurations, existing hydrotreating capacity and available feedstock crude oils. FIG. 2 depicts the equilibrium of aromatics produced in a diesel hydrotreating operation, as a function of both temperature and hydrogen pressure available. It will be recognized by one skilled in the hydrotreating of such fuels that a multitude of operating conditions which may be suitable for making a given diesel fuel composition exist, and that such variable will be refinery specific.

The following examples are intended to further describe the determination of one embodiment of our present invention, and not to limit the invention in any way.

EXAMPLE

We sought hot-start transient emissions results from a 1991 prototype Detroit Diesel Corporation Series 60 heavy-duty diesel engine using a California reference fuel, Fuel R, and Low Aromatics Diesel Fuels having the compositions of Table II, following the "CARB protocol" given in Section 2282, Aromatic Content of Diesel Fuel of Title 13, California Code of Regulations, effective Dec. 26, 1991. The protocol is based on transient emission measurement procedures developed by the U.S. Environmental Protection Agency for emissions regulatory purposes. The CARB protocol specifies that a prototype Detroit Diesel Corporation Series 60 be used as the "test bench" for comparing engine emissions using a California Reference diesel fuel and a candidate fuel. The diesel fuels we discovered are herein referred to as "Test Fuels A and B" and characterized by the properties given in Table II below. Test fuels C and D are outside the scope of this invention and are presented for comparison purposes.

The revised CARB protocol requires that fuel evaluations be conducted using either several cold- and hot-start transient test sequences or several hot-start transient tests alone using one of three "alternative" test sequences.

TABLE II

FUEL SPECIFICATIONS

| Property | Fuel A Spec | Fuel B Spec | Fuel C Spec | Fuel D Spec | ASTM Test Method |
|---|---|---|---|---|---|
| Sulfur content, ppm | 196 | 202 | 44 | 54 | ASTM D2622-82 |
| Polycyclic Aromatic Content, % by weight | 4.68 | 3.61 | 2.56 | 2.62 | ASTM D2425-83 |
| Nitrogen Content, ppm | 466 | 341 | 306 | 301 | ASTM D4629-86 |
| Cetane Number | 59 | 55 | 55 | 50 | ASTM D613-84 |
| Total Aromatics Hydrocarbon Content, % by weight | 19 | 15 | 16 | 19 | ASTM D5186-91 |
| Test Results | Passed | Passed | Failed | Failed | |

Fuels A and B contained 0.185 wt. % 2-ethyl-hexyl nitrate.
Fuel C contained 0.015 wt. % 2-ethyl-hexyl nitrate.

All transient emission tests were conducted according to the EPA Federal Test Procedure specified in Code of Federal Regulations, Title 40, Part 86, Subpart N, which also details procedures for the measurement of HC, CO, $NO_x$, and PM, and which is incorporated by reference herein.

The torque-map data for specific fuels confirmed that engine performance was generally consistent during the evaluation.

Sulfate is collected as "particulate", and its weight is assessed as part of PM emission. The California Air Resources Board protocol has a provision for correction of PM emission for differences in fuel sulfur content.

The hot-start transient emission results were analyzed in accord with the CARB protocol. Using Alternative 1, the individual emission values were accumulated for statistical analyses using the formula given in the CARB protocol.

The specified comparison for $NO_x$, PM, and SOF emissions centers on whether or not the average emission value using the Test Fuels A and B are less than an adjusted average emission value using the reference fuel. This comparison criterion was met for $NO_x$, PM and SOF. Statistical analyses of the HC and CO emissions are not required by the CARB protocol; therefore, no adjustment or tolerance is given in the protocol. However, the averages and standard deviations for HC and CO emissions are calculated for completeness, and their average emissions were arithmetically lower with the Test Fuels A and B than with the reference fuel.

A minimum of forty hot-start transient test sequences on the diesel fuel of Table II were performed for regulated and selected unregulated emissions following Alternative 1 of the CARB protocol for testing emission performance equivalency of the fuel of Table V to the California reference fuel. The CARB protocol-specified statistical analyses were performed on the average $NO_x$, PM and SOF emissions to determine whether the average emission value of Test Fuels A and B were less than the adjusted average value of the California reference fuel. The specified comparison criteria were met for Test Fuels A and B. Test Fuels C and D which were outside the limits for Cetane and Aromatics Content for this invention failed.

What is claimed is:

1. In a Low Emissions Diesel Fuel, the improvement which comprises a Diesel Fuel having an Aromatics Content in the range of from 13 to 20 percent by weight and a Cetane Number in the range of from 54 to 60, said Cetane Number and Aromatics Content being within the tetragonal area defined by Points A, B, C and D shown in FIG. 1, wherein the relationship of Cetane Number and Aromatics Content is expressed according to the equation:

Aromatics Content = Cetane Number − 40 within the limits such that:

Cetane Number − 40 < Aromatics Content ≦ Cetane Number − 40 and wherein 54 ≦ Cetane Number ≦ 60, whereby statistically determined emissions resulting from combusting said Low Emissions Diesel Fuel in a diesel engine are less than statistically determined emissions resulting from combustion of California Reference diesel fuel in said engine.

2. The Low Emissions Diesel Fuel according to claim 1 wherein the Cetane Number is in the range of from 55 to 59 and the Aromatics Content is in the range of 15 to 19 percent by weight and wherein the Cetane Number and Aromatics Content lie along Line A–B of FIG. 1.

3. The Low Emissions Diesel Fuel according to claim 2 wherein the Cetane Number is 59 and the Aromatics Content is 19 percent by weight.

4. The Low Emissions Diesel Fuel according to claim 2 wherein the Cetane Number is 55 and the Aromatics Content is 15 percent by weight.

5. The Low Emissions Diesel Fuel according to claim 1 further comprising less than about 202 ppm sulfur, less than about 466 ppm nitrogen, and less than about 4.68% by weight polynuclear aromatic compounds.

6. The Low Emissions Diesel Fuel according to claim 1 further comprising from about 0.05% to about 0.40% of a cetane improver.

7. The Low Emissions Diesel Fuel according to claim 6 wherein the cetane improver is 2-ethyl-hexyl nitrate.

* * * * *

Disclaimer 5,389,111 —Manuch Nikanjam, Richmond; Richard F. Sullivan, San Rafael, both of Calif. LOW EMISSIONS DIESEL FUEL. Patent dated February 14, 1995. Disclaimer filed April 21, 1995, by the assignee, Chevron Research And Technology Company.

Hereby enters this disclaimer to the remaining term of said patent.

(*Official Gazette* September 5, 1995.)